US006997640B1

(12) United States Patent
Hohmann, Jr.

(10) Patent No.: US 6,997,640 B1
(45) Date of Patent: Feb. 14, 2006

(54) BACKER ROD FOR EXPANSION JOINTS

(75) Inventor: Ronald P. Hohmann, Jr., Hauppauge, NY (US)

(73) Assignee: Hohmann & Barnard, Inc., Hauppauge, NY (US)

( * ) Notice: Subject to any disclaimer, the term of this patent is extended or adjusted under 35 U.S.C. 154(b) by 0 days.

(21) Appl. No.: 11/111,609

(22) Filed: Apr. 21, 2005

(51) Int. Cl.
*E01C 11/00* (2006.01)

(52) U.S. Cl. ..... 404/67; 404/47; 14/73.1

(58) Field of Classification Search ..... 14/73.1; 404/47, 48, 56, 67, 68, 69, 72, 74, 75, 17, 404/18, 28, 29, 31
See application file for complete search history.

(56) References Cited

U.S. PATENT DOCUMENTS 4,931,484 A * 6/1990 Hovis et al. ..... 521/143
5,007,765 A * 4/1991 Dietlein et al. ..... 404/74
5,024,554 A * 6/1991 Benneyworth et al. ..... 404/74
5,059,631 A * 10/1991 Hovis et al. ..... 521/79
5,098,782 A * 3/1992 Hovis et al. ..... 428/314.4
5,190,395 A * 3/1993 Cathey et al. ..... 404/74
5,277,515 A * 1/1994 Hovis et al. ..... 404/74
5,300,171 A * 4/1994 Braun et al. ..... 156/249
5,387,050 A * 2/1995 Hovis et al. ..... 404/74
5,439,319 A * 8/1995 Flanagan et al. ..... 405/152
6,039,503 A * 3/2000 Cathey ..... 404/67
6,497,078 B1 * 12/2002 Haque et al. ..... 52/417
6,666,618 B1 * 12/2003 Anaya et al. ..... 404/68
2005/0141961 A1 * 6/2005 Steffes ..... 404/75

* cited by examiner

*Primary Examiner*—Thomas B. Will
*Assistant Examiner*—Alexandra Pechhold
(74) *Attorney, Agent, or Firm*—Siegmar Silber

(57) ABSTRACT

A backer rod adapted for insertion into a construction joint having a polymeric foam body of closed-cell construction and a foraminous skin with both open and closed cells. The backer rod, when compressively inserted into a construction joint, is impervious to hot and cold sealants alike and maintains the seal integrity during the extremes of expansion and contraction. The backer rod is usable over the temperature range of −70 to 450 degrees Fahrenheit. The backer rod hereof is a continuously extruded closed-cell foam body that is degassed by a secondary extrusion. The skin portion is formed by heat treating the exterior of the polymeric foam body so as to create microperforations therein.

15 Claims, 1 Drawing Sheet

BACKER ROD FOR EXPANSION JOINTS

BACKGROUND OF THE INVENTION

1. Field of the Invention

This invention relates to universally applicable backer rods for expansion joints, and, more particularly, for masonry expansion joints, a backer rod that controls the depth of sealants used therein.

2. Background Information

In the past standard backer rods for sealant control have been developed from closed cell polyethylene foam. These standard backer rods are extruded round rods of low-density, polyethylene (LDPE) material with a self-skinned outer covering. Upon use and prior to a sealant being applied, masonry backer rods are inserted into joints between two cured masonry sidewalls. In nominal terms, the backer rod, which has a diameter approximately 125% of the joint width, is compressively inserted into the joint and is installed at a depth of one-half the width thereof.

The standard backer rod is inserted in the expansion joint as hereinbefore described and the cavity remaining above the backer rod is filled with a cold sealant. In practice, the cavity is generally slightly overfilled with the sealant and the excess removed in an additional installation step. Over time with the impact of usual ambient conditions, air bubbles are released from the cells of the standard backer rod foam and migrate to the surface of the sealant.

The air bubbles released from the foam are described in the technical literature as outgassing. This is somewhat misdescriptive as the blowing gases used to create the foam have dissipated during curing. The appearance of bubbles at the surface of an expansion joint spoils the surface integrity and is unappealing. Also, such appearance indicates a possible failure of the seal provided by the underlying backer rod as the migrating air bubbles leave behind collapsed foam cells The collapsed cells of the backer rod change the compression and recovery characteristics thereof which need to be maintained during the expansion and contraction of the construction elements (or sidewalls).

To meet architectural standards and building code requirements, the installed standard backer rod needs to exhibit several specific physical properties. The first of these is inertness so that the self-skinned, polyethylene foam structure does not react with to the sealant materials. In the past it was also believed that the sealant and the backer rod should operate independently from one another and thus, besides being inert, it was desired that the backer rod not adhere to the sealant. The backer rod also must be stable over a broad temperature range, provide low water absorption, and adequate insulative qualities. When the seal of the backer rod materials in the expansion joint fails, the failure often is indicated by the previously described outgassing which over time produces unsightly bubbling at the surface of the sealant.

As an alternative to the standard backer rod, a temperature-resistant backer rod formed from crosslinked, closed-cell polyethylene has been marketed for use with hot-pour sealants. This backer rod is rated to temperatures in the range of 400° F. and is chemically inert resisting oil, gasoline and other solvents. The outer skin being of crosslinked polyethylene is smooth and impenetrable by the hot-pour sealant.

A further alternative to the standard backer rod is a soft rod or cool rod specifically designed as a compressible backing material for use in conjunction with cold-applied joint sealants. In this configuration the backer rod is a mix of closed- and open-cell structures and is substantially uniform throughout. Within the restrictive use, the soft rod design is promoted as being a non-outgassing structure.

Under the jurisdiction of ASTM Committee C-24 on Building Seals and Sealants, a standard has been developed for the construction industry entitled Standard Test for Determining the Outgassing Potential of Sealant Backer, ASTM Designation C 1253-93 (Reapproved 1998). According to ASTM, this test method provides an indicator of a potential sealing problem that could occur if a sealant backer is flawed in manufacture or transportation to the job site or is abused during the installation.

The testing reveals that some below-standard sealant backer materials, upon exposure to certain environmental conditions, can outgas, and create voids in the applied sealant before the sealant cures. The ASTM Standard further suggests that such voids potentially compromise the intended performance of the cured sealant. Voids are also known to be caused by other means and under certain conditions, such as air entrapment during sealant application, trapped air in the substrate releasing into the uncured sealant, incompatibility of the sealant with the sealant backer or substrate, or inhospitable installation conditions in the field, Therefore, the C 1253-93 test method is limited to identifying the outgassing potential of a punctured sealant backer by formation of a void in the soft uncured sealant under conditions of heat and compression.

In addition to the standard backer rod material of closed cell polyethylene, supra, and in preparing for this application, the inventor hereof came to know U.S. Pat. No. 5,277,515 of Hovis, et al., dated Jan. 11, 1994, and entitled, Extruded ethylenic polymer foam containing both open and closed cells. The Hovis '515 patent, one of several related Hovis patents, discloses an ethylenic polymer foam for a sealed building joint. The material is an extruded, low density, non-outgassing ethylenic polymer foam containing 30–85% open cells and the remainder closed cells with a self-skinned exterior surface. In the patent, the compression recovery and lower compression resistance of the foam is presented as being superior to similarly comprised ethylenic closed cell foams. Additionally, the foam is presented as having superior moisture resistance and handling characteristics when compared to open cell foams.

The prior art also provides several examples of roadway expansion joint structures and methods of use. Gibbon et al., U.S. Pat. No. 4,699,540 describes an expansion joint having a tube-shaped preform, preferably of a heat-cured silicone rubber, for insertion in the expansion joint as a sealing element. Gibbon '540 takes a silicone elastomer, which is pigmented and then catalyzed with a peroxide catalyst. The composition is extruded through a die followed by heat treatment either by heating in an air tunnel or heating in a salt bath.

Another backer rod used in roadway expansion joints is that of Dietlin et al., U.S. Pat. No. 5,007,765. Here, similar to the standard backer rod, supra, the inventor describes an open cell foam with an impervious skin. Because of its resiliency, the open cell foam can be sealed against any deformities or projections on the joint surface. In roadway expansion joint applications in which flowable sealants are used, the resiliency of the backer rod provides a seal against rough surfaces. However, as described below the backer rod of this invention provides a material better suited to masonry applications and substantially vertical expansion joints.

The term outgassing is a misnomer implying that the backer rod contains some sort of mysterious gas when in fact the closed cell backer rod cells contain only atmospheric air at atmospheric pressure. If a closed cell backer rod is torn or punctured during installation and sealant is applied, a bubbling situation in concert with a number of other factors may arise. This can occur as the sun warms up the joint causing the structure being sealed to expand and compress the rod squeezing the entrained air in the tear or puncture into the sealant. This warming can also cause the air in the void itself to expand due to thermal expansion and if this heating continues and a low viscosity slow curing sealant is used bubbling may occur. This can again be a problem if sealants are applied soon after overcompression.

The overcompression causes an undesired large increase in cell pressure which over time may be relieved into the sealant. Twist points in the rod can cause creases in the rod which can be extremely difficult to fill with sealant. If air is entrained and the conditions of 1 above occur, the entrained air can expand causing bubbling. Tiny voids in the concrete which if covered with sealant are entrained pockets of air which can expand with heating by the sun and cause bubbling.

Further, in the past, manufacturers of backer rods have sought to provide job-specific backer rods. Consequently, certain backer rods are specified for use with cold sealants and not for hot sealants. Others are specified for use with hot sealants only. Such specificity of product application leads to storage, order fulfillment, and quality control problems. It is readily seen that the provision of a universal backer rod as described hereinbelow resolves such problems and avoids technical considerations of selecting the specific backer rod for the application.

Expansion joint seals have not generally been viewed as unitary structures, and separate technical details of the sealants and the backer rods have been maintained. In the following, the sealant is interspersed in and within the open cells of the backer rod and becomes strongly mechanically bonded thereto. The expansion joint seal, unlike those described in the patents above, because of the mechanical bond, expand and contract as a unit and do not operate independently.

The submission of the above discussion of documents is not intended as an admission that any such document constitutes prior art against the claims of the present application. Applicant does not waive any right to take any action that would be appropriate to antedate or otherwise remove any listed document as a competent reference against the claims of the present application.

SUMMARY

In general terms, the invention disclosed hereby includes in the device embodiment described hereinbelow, a backer rod adapted for insertion into a construction joint having a polymeric foam body of closed-cell construction and a foraminous skin with both open and closed cells. The backer rod, when compressively inserted into a construction joint, is impervious to hot and cold sealants alike and maintains the seal integrity during the extremes of expansion and contraction. The backer rod has been termed universal as the device is usable over the temperature range of −70 to 450 degrees Fahrenheit.

The backer rod of this invention has a polymeric foam body portion of continuously extruded closed-cell foam, which polymeric foam body is degassed by a secondary extrusion. The skin portion is formed by heat treating the exterior of said polymeric foam body so as to create microperforations therein. Being prepared in this way, the polymeric foam of the backer rod is nonreactive over the previously recited temperature range to both hot-pour and cold-applied sealants. Further, as a result of the secondary extrusion, the polymeric foam body is rendered non-outgassing per ASTM C 1253.

OBJECTS AND FEATURES OF THE INVENTION

It is an object of the present invention to provide a backer rod for expansion joints which is economical to manufacture and is readily and simply installed.

It is another object of the present invention is to provide a universal backer rod of a polymeric foam material having a core of closed cells and a self-skinned exterior of open and closed cells.

It is a further object of the present invention to provide a backer rod that meets outgassing standards and conforms to and exceeds ASTM Designation C 1253-93 (Reapproved 1998).

It is a yet further object of the invention to provide a backer rod which operates over the entire −70° F. to 425° F. temperature range thereby suiting it for use with both hot and cold sealants.

It is a feature of the present invention that the self-skinned surface has a mixture of both open and closed cells and the sealant-accepting region thereof receives sealant in the interstices of the open cells to form a mechanical bond therebetween.

It is another feature of the present invention that, upon the backer rod being compressively installed between two structural elements, the open cells in the surface-contacting region are sealed making the sealant cavity impervious to liquid flow therethrough.

Other objects and features of the present invention will become apparent upon reviewing the drawing and reading together therewith the description which follows.

BRIEF DESCRIPTION OF THE DRAWINGS

In the following drawing, the same parts in the various views are afforded the same reference designators.

DESCRIPTION OF THE PREFERRED EMBODIMENTS

This invention discloses a universal backer rod for emplacement in a construction joint formed by two structural elements. The backer rod is formed from a polymeric foam, typically low-density polyethylene (LDPE), and is compressively inserted between the two elements. Although traditionally backer rods were customized for particular applications, e.g., hot rods for use with hot-pour sealants and soft rods for use with cold-applied sealants, the backer rod of this invention is of service over the entire range of −70° F. and 450° F.

Before proceeding with further details of the specification, several definitions are provided to aid in the understanding of the device. Wherever possible usage as close to the common understanding of the terms is adopted.

The backer rod is extruded from a polymeric foam. A polymeric foam is defined as a thermoplastic material that, after being subjected to a foaming or blowing agent, produces a cellular structure.

The backer rod is comprised of a closed-cell body portion and a foraminous skin portion. A foraminous skin portion is defined as a self-skinned outer portion of the backer rod that has open and closed cells on the surface thereof. The foraminous skin portion is further defined as the skin formed upon heat treating the outer portion of the polymeric foam body.

In use, the backer rod is compressively inserted into a construction joint between two structural components. The sealant cavity is defined as the open trough formed by the two facing surfaces of the structural components and the sealant-receiving region of the backer rod. When the backer rod is inserted at a predetermined depth, the joint seal requires a calculatable amount of sealant.

Figure 1:
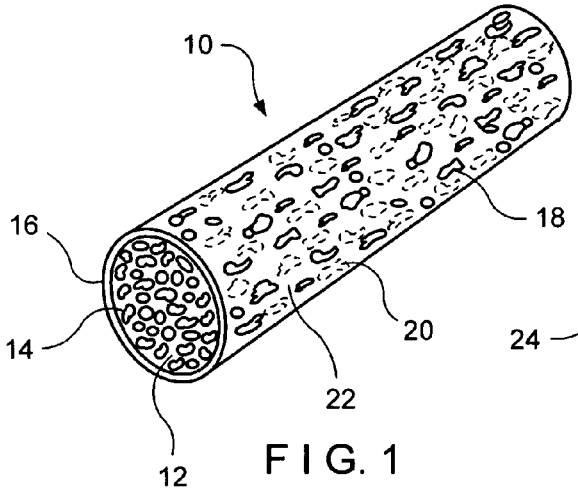
FIG. 1 shows a backer rod of this invention and is a cutaway perspective view from above showing in representational form a closed cell core and a foraminous skin with open and closed cells.

Referring now to FIG. 1, a backer rod of the present invention is shown and is referred to generally by the reference designator 10. The backer rod 10 is formed from a low-density polyethylene and the polymeric foam body 12 is constructed from closed cells 14. During the extrusion the backer rod 10 undergoes a secondary extrusion, which extrusion forces out any remanent blowing agent or foaming agent. Any foaming agent displaced from the closed cells of the structure and is replaced by ambient atmosphere. The resultant foam body of the backer rod has a density of between 1.0 and 3.0 lb. per $ft^3$.

The backer rod 10 has a foraminous skin portion 16 with open cells 18 and closed cells 20. The open cells or pores 18 are formed by heat treating the exterior of the polymeric foam body 14 and open onto exterior surface 22 of the backer rod 10. The apertures in the exterior surface 22 have diameters in the range of 0.001 inch and 0.090 inch and have between 50 and 1000 openings per square inch. Unlike the smooth-skinned, prior art application-specific backer rods described hereinabove, the texture of the exterior surface 22 is rough and irregular approaching an almost snake-skin or rasp-like feel.

Figure 2:
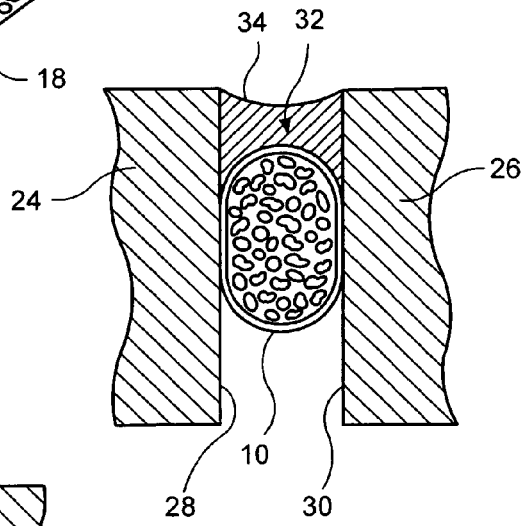
FIG. 2 is a cross sectional view taken along a plane normal to the longitudinal axis of the backer rod of this invention, wherein the backer rod is shown installed between two construction elements and having sealant disposed thereon.
Figure 3:
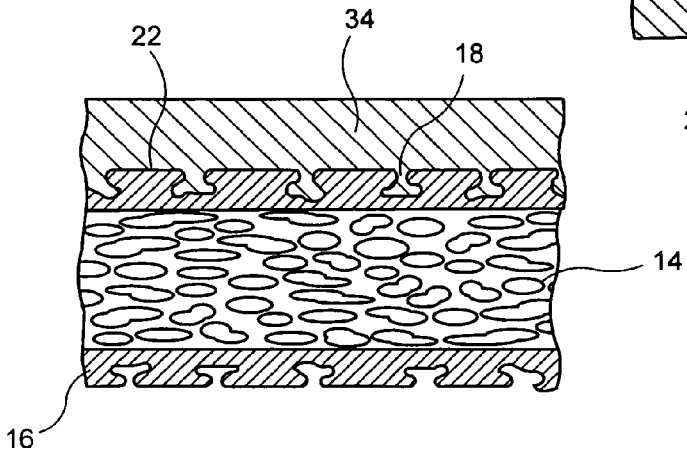
FIG. 3 is a cross sectional view taken along a plane bisecting the sealant cavity showing the installed backer rod with sealant disposed within the interstices of the skin structure thereof; and, FIG. 4 is a cross sectional view, similar to FIG. 2, showing the relationship of the installed backer rod to the construction elements for defining the sealant-accepting region and the surface-contacting region of the backer rod.
Figure 4:
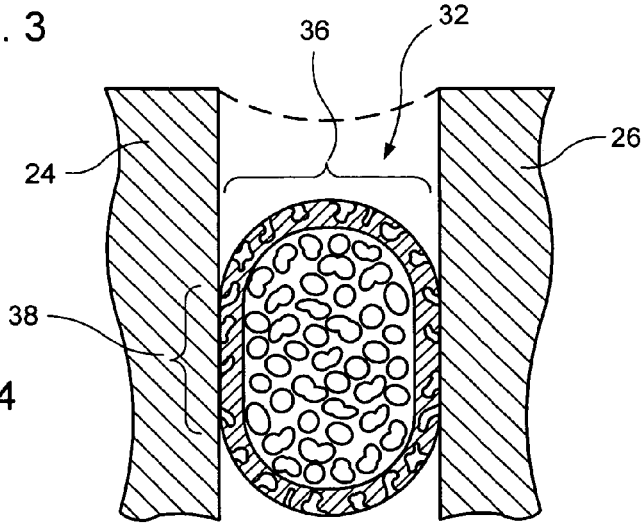

Referring now to FIGS. 2 through 4, further details of the backer rod 10 of this invention are shown. In these figures the backer rod 10 is shown installed between two construction elements or components 24 and 26 having facing surfaces 28 and 30, respectively. As seen most readily in FIGS. 2 and 4, a backer rod 10 having a diameter about 125% of the width of the joint is compressively mounted within the opening. The recovery force of the foam body pushes a portions of the foraminous skin portion 16 against surfaces 28 and 30 sealing the open cells thereof and forming an impervious sealant cavity 32. The fluid imperviousness is such that, when the backer rod 10 of this invention accepts sealants thereupon, the seal integrity is maintained throughout any expansion and contraction.

It is noteworthy that the backer rod 10 of this invention is universal in application as it functions over the temperature range of −70° to 450° F. Thus, sealant 34 is selectable from any of the hot-pour and cold-applied sealants—most popularly any bituminous sealant or rubber-asphalt, and any silicone sealant, butyl sealant, polysulfide sealant, acrylic sealant, or poly-urethane sealant. When the backer rod 10 is inserted between the construction elements 24 and 26 at a predetermined depth, the volume of sealant applied to the sealant cavity 32 is calculable.

As shown in schematic form in FIG. 3, a mechanical bond is formed by the interspersal of the sealants 34 into the interiors or interstices of the open cells or microperforations 18. The penetration and the extent of the mechanical bond of course depends on the aperture size and the viscosity of the sealant 34 at time of application. However the teaching here is antithetical to the prior art which indicates that after installation the sealant and the backer rod should readily yield to attempts to separate the two components. Here advantage is seen in forming a unitary structure.

The foraminous skin 16 of backer rod 10 of this invention is further described, upon installation, as having a sealing-accepting region 36 and a contact region 38 that is compressively abutted against construction elements 24 and 26. The sealing-accepting region 36 is the floor of the sealant cavity 32 and with the compressive insertion the backer rod is bowed in a manner that opens the pore structure to receive the sealant 34.

Two sizes of the universal backer rod 10 of this invention, in independent laboratory testing, is subjected to the ASTM test protocol for ASTM # 1253-93. A sample of the backer rod material is placed between nonporous substrates in a compressed condition, simulating the placement of a backer rod between two construction elements. As directed in Guide C 1193, the backer rod is then punctured at intervals along its exposed face. A sealant is applied immediately after puncture, and it is tooled to make a typical butt joint After tooling, the specimen is placed in an air circulating oven at elevated temperature for 1 hour and then removed. The specimen is compressed 12½% and returned to the oven, where it remains for another 2 hours. The specimen, while in the compressed condition, is removed from the oven, and the sealant completes the curing process at room temperature.

The sealant is then removed from the specimen, and the back face (the face against the backer rod) is examined. The sealant is slit in half along its length and the size of any voids estimated.

| Sample | Compounds Outgassed |
|---|---|
| Dark Grey Foam Backer Rod: 1.5" Dia | No Voids |
| Light Grey Foam Backer Rod: 1" Dia | No Voids |

The backer rod of this invention exhibits temperature stability over the −70° to 450° F. range in contrast to the application-specific backer rods presently in the marketplace and maintains the seal integrity at both ends of the ambient temperature range.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A backer rod adapted for insertion into a construction joint, said backer rod comprising:

a polymeric foam body portion of closed-cell construction; and a foraminous skin portion about said body portion, said backer rod adapted, when compressively inserted into said construction joint, to imperviously accept sealants disposed thereupon and to maintain seal integrity during expansion and contraction, said foraminous skin portion, in turn, further comprising;

open-cell pores opening onto the exterior surface of said backer rod; and, a plurality of closed surface cells.

2. A backer rod as described in claim 1 wherein said open-cell pores are adapted, when oriented with sealant disposed thereupon, to receive sealant therein and provide a mechanical bond between said sealant and said backer rod.

3. A backer rod as described in claim 2 wherein said backer rod maintains said seal integrity over the temperature range of −70° F. to 450° F.

4. A backer rod as described in claim 1 wherein said open-cell pores have apertures in the surface thereof with diameters in the range of 0.001 inch and 0.090 inch.

5. A backer rod as described in claim 1 wherein said polymeric foam body has a density of between 1.0 and 3.0 lb. per $ft^3$.

6. A backer rod as described in claim 1 wherein said foraminous skin portion has between 50 and 1,000 openings therethrough per square inch of surface area.

7. A backer rod for insertion in a construction joint between the surfaces of two adjacent structural components and for providing a seal therebetween, said backer rod comprising:

a polymeric foam body portion of continuously extruded closed-cell foam, said polymeric foam body being degassed by secondary extrusion;

a skin portion about said body portion, said skin portion formed by heat treating the exterior of said polymeric foam body to form microperforations therewithin;

said backer rod upon compressive insertion thereof between said two structural components forms a fluid impervious seal and a cavity adapted to receive sealants disposed thereon, said skin portion, in turn, comprises;

a contact region compressed against said surfaces of said two adjacent structural components and sealing said microperforations therein;

a sealant-accepting region forming one wall of said cavity, said microperforations of said sealant-accepting region adapted to receive said sealant into the interstices thereof and form a mechanical bond therewith.

8. A backer rod as described in claim 7 wherein said contact region further comprises:

an adhesive layer of pressure sensitive adhesive, said adhesive being activated upon said compressive insertion of said backer rod between said two structural components.

9. A backer rod as described in claim 7 wherein said backer rod maintains seal integrity over the temperature range of −70° F. to 450° F. and is nonreactive with a sealant selected from the group consisting of hot-pour sealant and cold-applied sealant.

10. A backer rod as described in claim 9 wherein said group of a hot-pour sealant and a cold-applied sealant further consists of a bituminous sealant, a silicone sealant, a butyl sealant, a polysulfide sealant, an acrylic sealant, a polyurethane sealant, and a rubber-asphalt sealant.

11. A backer rod for insertion in construction and pavement joints to control sealant depth in expansion joints between the surfaces of two adjacent structural components and for providing an all-temperature seal therebetween, said backer rod comprising;

a polymeric foam body portion of continuously extruded closed-cell foam, said polymeric foam body being degassed by secondary extrusion and adapted to be nonreactive over the temperature range of −70° F. to 450° F. with a sealant selected from the group consisting of a hot-pour sealant and a cold-applied sealant;

a foraminous skin portion about said body portion, said foraminous skin portion formed by heat treating the exterior of said polymeric foam body to form open-cell pores therewithin, said open-cell pores have diameters in the range of 0.001 inch and 0.090 inch and said foraminous skin portion has between 50 and 1,000 openings per square inch of surface area;

whereby, upon compressively inserting said backer rod between said two structural components, a fluid impervious seal is formed, said seal adapted to receive a sealant disposed thereupon and to maintain the requisite fluid imperviousness.

12. A backer rod as described in claim 11 wherein said group of a hot-pour sealant and a cold-applied sealant further consists of a bituminous sealant, a silicone sealant, a butyl sealant, a polysulfide sealant, an acrylic sealant, a polyurethane sealant, and a rubber-asphalt sealant.

13. A backer rod as described in claim 11 wherein said open-cell pores are adapted to receive said sealant therewithin.

14. A backer rod as described in claim 13 wherein said backer rod is adapted to be controllably and compressively inserted between two adjacent structural components at a predetermined depth and forming a sealant cavity of known volume per linear unit.

15. A backer rod as described in claim 14 wherein said secondary extrusion forces any remnant foaming agent from the cells and replaces said blowing gases with ambient atmosphere.

* * * * *